US007611362B2

(12) United States Patent
Lin

(10) Patent No.: US 7,611,362 B2
(45) Date of Patent: Nov. 3, 2009

(54) ELECTRICAL CONNECTOR

(75) Inventor: Chia-Shih Lin, Tu-cheng (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 12/215,212

(22) Filed: Jun. 25, 2008

(65) Prior Publication Data

US 2008/0318452 A1 Dec. 25, 2008

(30) Foreign Application Priority Data

Jun. 25, 2007 (TW) ..... 96210284 U

(51) Int. Cl.
*H01R 12/00* (2006.01)

(52) U.S. Cl. ..... 439/79; 439/924.1

(58) Field of Classification Search ..... 439/79, 439/660, 733.1, 924.1
See application file for complete search history.

(56) References Cited

U.S. PATENT DOCUMENTS 6,960,089 B2 * 11/2005 Lee et al. ..... 439/79
2006/0099836 A1 5/2006 Ho

FOREIGN PATENT DOCUMENTS

TW M271277 7/2005

* cited by examiner

*Primary Examiner*—Khiem Nguyen
(74) *Attorney, Agent, or Firm*—Wei Te Chung; Andrew C. Cheng; Ming Chieh Chang

(57) ABSTRACT

An electrical connector comprises a dielectric housing comprising a mating face, a rear face opposed to said mating face, and a plurality of first passages extending from said rear face to said mating face, a plurality of first conductive contacts respectively secured in said dielectric housing, wherein said first conductive contacts are manufactured according to the same specification, each first conductive contact comprises a retaining portion, a contacting portion extending from a end of said retaining portion, and a mounting portion extending from the end opposite to said contacting portion, wherein said retaining portions and contacting portions of said first conductive contacts are respectively inserted into corresponding said first passages at different depths, said retaining portion secured in corresponding said first passage, said contacting portion exposed in corresponding first passage, said mounting portion extending out from said rear face.

13 Claims, 3 Drawing Sheets

ELECTRICAL CONNECTOR

BACKGROUND OF THE INVENTION

1. Field of the Invention

The present invention is generally related to an electrical connector, and especially, to an electrical connector having easy to assembly conductive contacts.

2. Description of Related Art

An electrical connector, adapted to standard peripheral equipment, such as hard disks, optical disks, etc., such as those meeting the Serial ATA (Advanced Technology attachment) specification, are designed to supply electric currents having different voltage values while being capable of transmitting electric signal data at high speeds, and can even be coupled to or detached from peripheral equipment when an electronic device is running, achieving the so-called hot plugging feature.

In order to achieve the hot plugging function, in practice of a serial ATA electrical connector, the conductive contacts are generally designed to have different lengths. That is, for a conductive contact dedicated to detection, the length of its contact portion, which is disposed to electrically contact a corresponding electrical connector, is shorter than that of contact portions of other conductive contacts that are dedicated to signal transmission. Thus, during the process of inter-engagement of the electrical connector and the corresponding electrical connector, the detecting conductive contact will achieve electrical connection last. On the contrary, during the process of disengagement of the electrical connector from the corresponding electrical connector, the detecting conductive contact will be the first to achieve electrical disconnection, thereby ensuring stability of data transmission.

Since conductive contacts of at least two different lengths are required, in the case of the currently adopted manufacturing process of using a machine to assemble the same to an insulating housing by "strip insertion," it is necessary to punch long and short conductive contacts from the same material strip. Therefore, during the punching process, punching machinery has to be programmed to automatically perform replacement and adjustment of punching molds when the length of the contacts on the material strip varies. Hence, compared with continuous punching of conductive contacts of the same length, it takes time to replace and adjust the molds, thereby increasing the overall punching time relatively and reducing the manufacturing efficiency considerably. On the other hand, to meet the requirement of punching conductive contacts of different lengths, in the design of molds, the structure of such molds will be more complicated than those for punching conductive contacts of the same length, thereby increase costs of manufacture.

Hence, an improved connector assembly is required to overcome the disadvantages of the prior art.

SUMMARY OF THE INVENTION

An object of the present invention is to provide an electrical connector for electrical connection between a complementary electrical connector and a printed circuit board comprising.

An electrical connector comprises a dielectric housing comprising a mating face, a rear face opposed to said mating face, and a plurality of first passages extending from said rear face to said mating face, a plurality of first conductive contacts respectively secured in said dielectric housing, wherein said first conductive contacts are manufactured according to the same specification, each first conductive contact comprises a retaining portion, a contacting portion extending from a end of said retaining portion, and a mounting portion extending from the end opposite to said contacting portion, wherein said retaining portions and contacting portions of said first conductive contacts are respectively inserted into corresponding said first passages at different depths, said retaining portion secured in corresponding said first passage, said contacting portion exposed in corresponding first passage, said mounting portion extending out from said rear face.

Other objects, advantages and novel features of the present invention will become more apparent from the following detailed description of the present embodiment when taken in conjunction with the accompanying drawings.

DETAILED DESCRIPTION OF THE INVENTION

Reference will now be made in detail to the preferred embodiment of the present invention.

Figure 1:
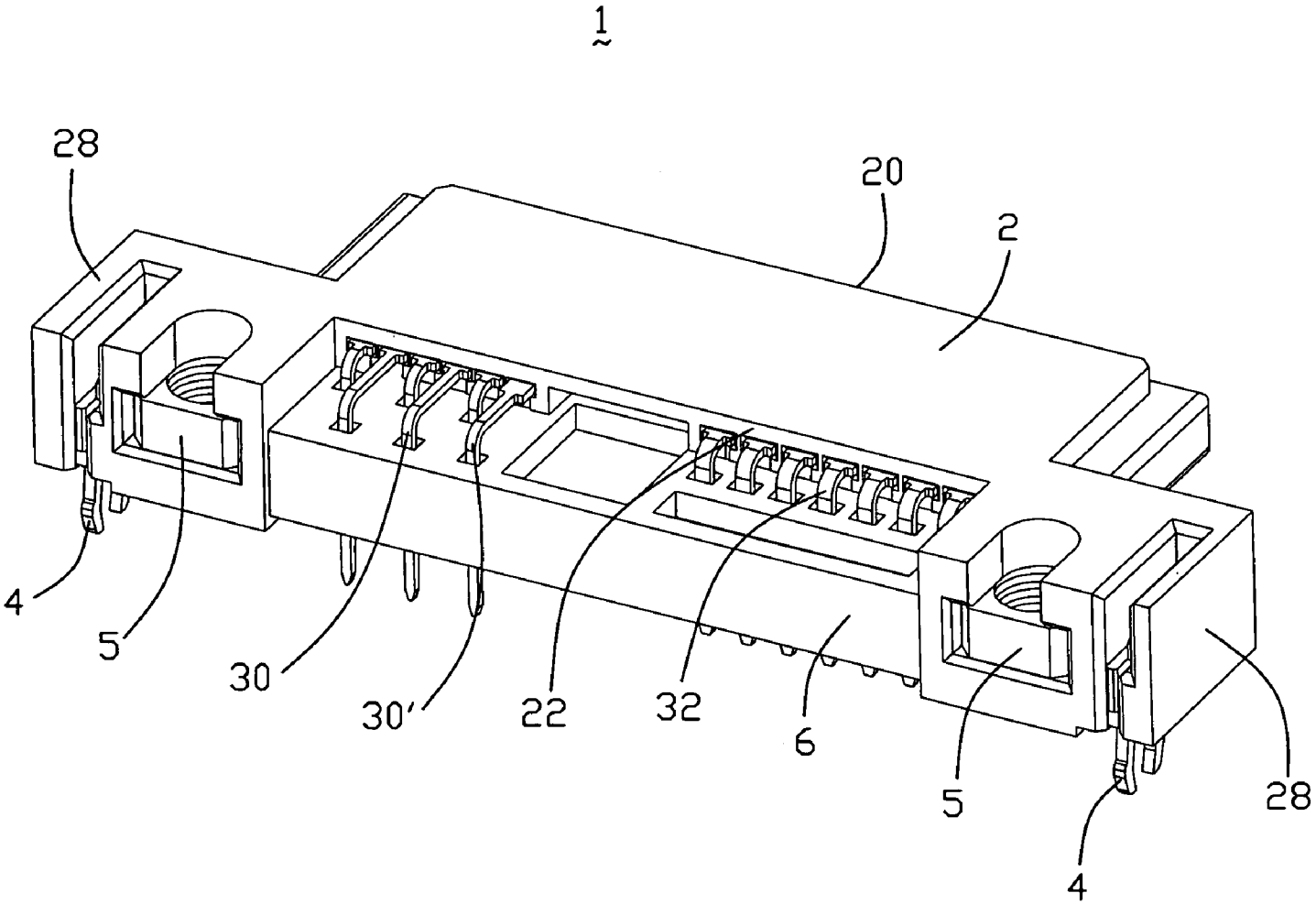
FIG. 1 is a perspective view of an electrical connector of a preferred embodiment of the present invention.
Figure 2:
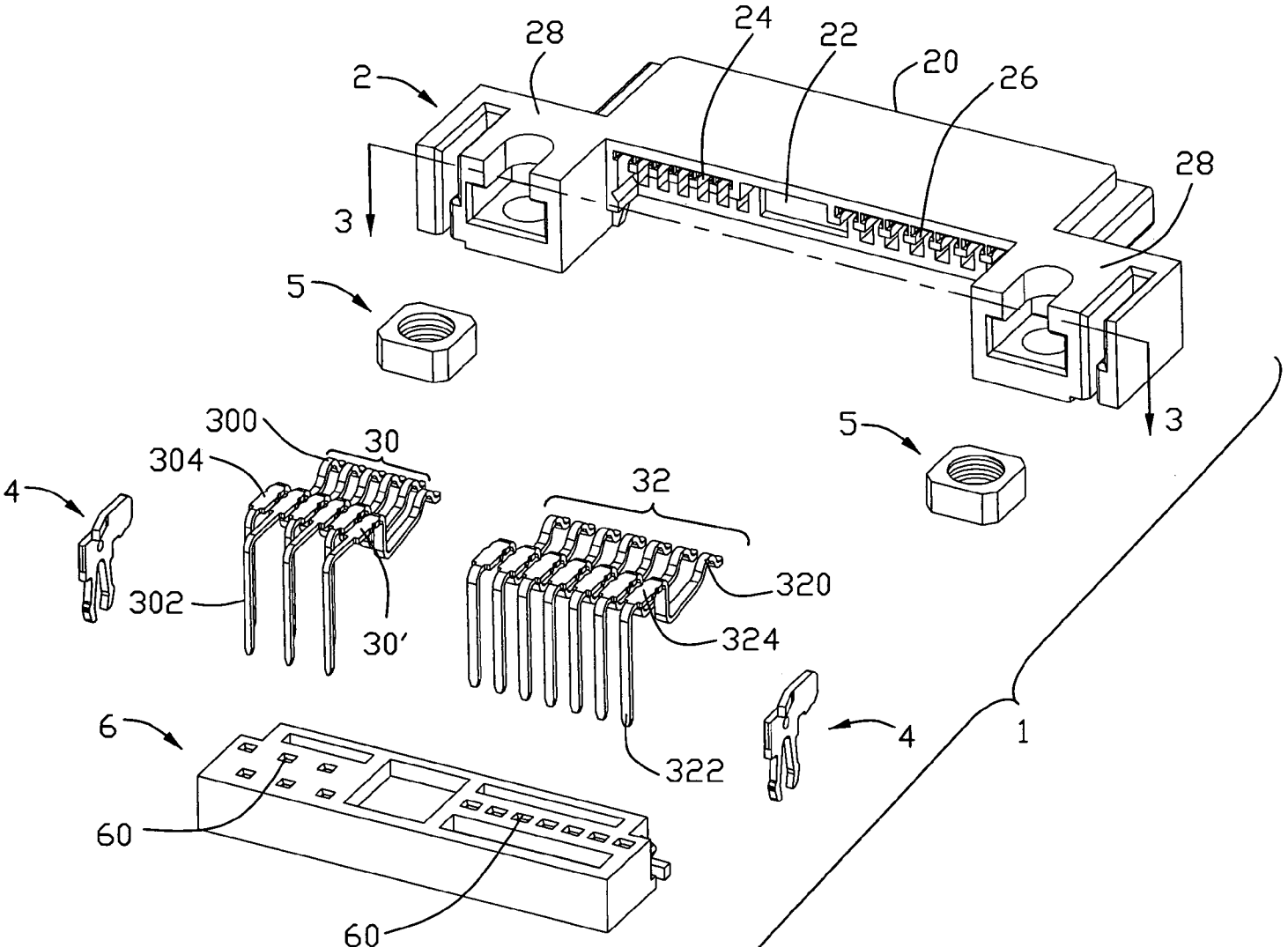
FIG. 2 is an exploded, perspective view of the electrical connector as shown in FIG. 1.
Figure 3:
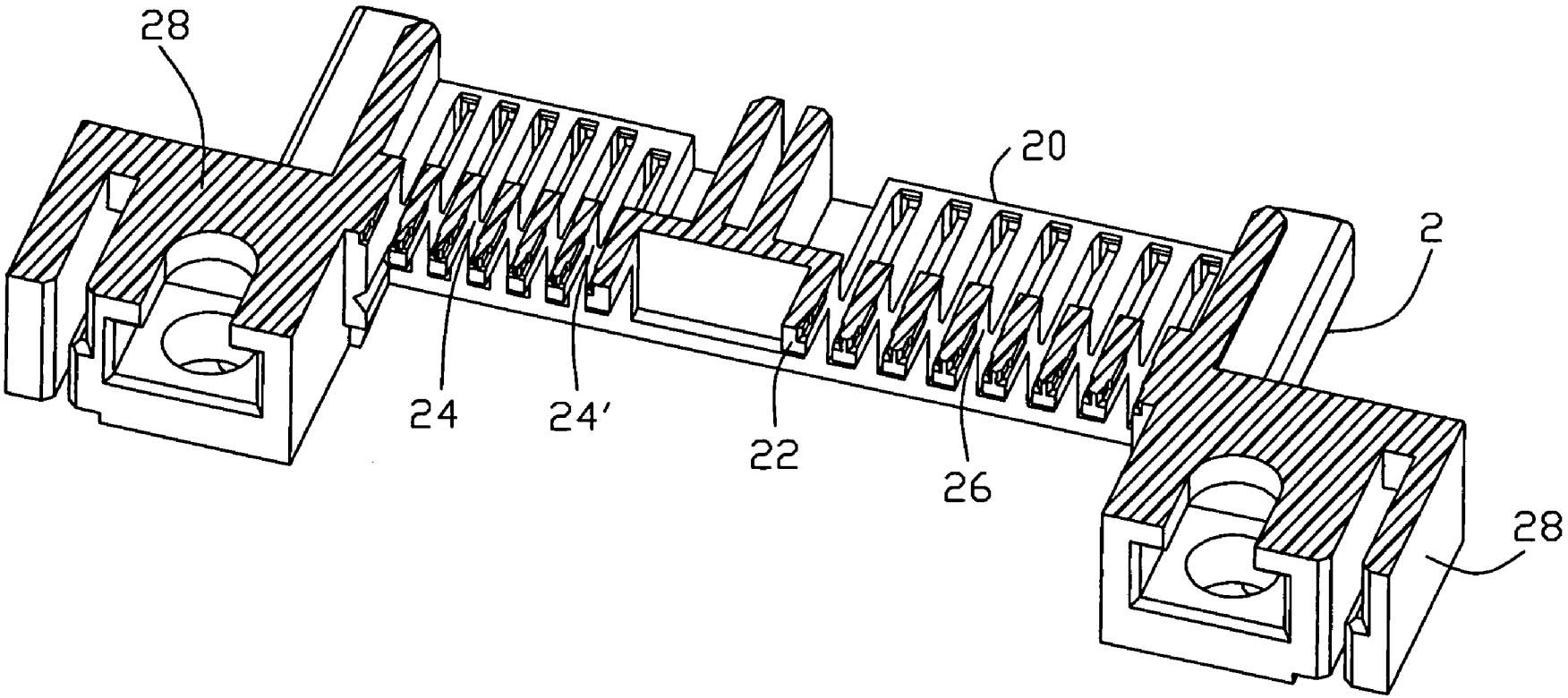
FIG. 3 is section view, along line 3-3, of the housing of the electrical connector shown in FIG. 2.

Referring to FIGS. 1-3, an electrical connector for electrical connection between a complementary electrical connector and a printed circuit board comprises a dielectric housing and a plurality of first conductive contacts and second conductive contacts respectively secured in said dielectric housing.

The dielectric housing comprises a mating face, a rear face opposed to said mating face, and a plurality of first passages and second passages extending from said rear face to said mating face. Wherein, the interface of the mating face matches the definition of the serial ATA standard specified, the rear face has a planar surface; the length of the first passage in the proximity of the second passages is shorter than the lengths of others whose lengths are the same.

said first conductive contacts are manufactured according to the same specification while at least one of first conductive contacts is inserted into said dielectric housing at a depth shallower than others. each first conductive contact comprises a retaining portion for retained in said dielectric housing, a contacting portion extending from a end of said retaining portion for electrical connection with the complementary electrical connector, and a mounting portion extending from the end opposite to said contacting portion for electrical connection with the printed circuit board, wherein the retaining portion of said at least one of first conductive contacts is inserted into said dielectric housing at a depth shallower than others do partially projects out from said planar face of the rear face. wherein said mounting portion of the first conductive contacts is bent downwardly in several rows while the mounting portion of the one inserted into said dielectric housing at a depth shallower than others is not in the row near said planar face. wherein each first conductive contact has the same shape and size while the mounting portion of each first conductive contact can be cut into different length and can be bent in different position after inserted into said dielectric housing.

The second conductive contacts respectively are inserted into corresponding passages in the right portion of the dielectric housing from the rear face.

The dielectric housing 2 comprises two retaining blocks 28 symmetrically defined on the two elongate ends. Each retaining block 28 comprises a board lock 4 and a securing nut 8 mounted therein. The electrical connector 1 further comprises a spacer 6 between the two retaining blocks 28. The spacer 6 defines a plurality of through holes 60 corresponding to the vertical section of the mounting portion 302, 322 of conductive contact 30, 32 for holding mounting portion 302, 322 of each said conductive contact 30, 32 in certain position.

Since the shape and size of the first conductive contacts 30 is the same and the mounting portion 302 is a thin long rod has a same cross section, all first conductive contacts 30 can be manufactured according to a same specification. But, when assembly, the first conductive contact 30 dedicated to detection is inserted into shorter passage 24 at a depth shallower than others, and let the retaining portion of partially projects out from the planar face of the rear face, then the mounting portions of the first conductive contacts are cut into different length and are bent in two rows after inserted into said dielectric housing. So, there is no need to punch first conductive contacts 30, 30' of different lengths, in the design of molds, the structure of such molds will be more simple than those for punching conductive contacts of the different length, thereby decrease costs of manufacture.

While a preferred embodiment in accordance with the present invention has been shown and described, equivalent modifications and changes known to persons skilled in the art according to the spirit of the present invention are considered within the scope of the present invention as described in the appended claims.

What is claimed is:

1. An electrical connector comprising: a dielectric housing comprising a mating face, a rear face opposed to said mating face, and a plurality of first passages extending from said rear face to said mating face; a plurality of first conductive contacts respectively secured in said dielectric housing, wherein said first conductive contacts are manufactured according to the same specification, each first conductive contact comprises a retaining portion, a contacting portion extending from a end of said retaining portion, and a mounting portion extending from the end opposite to said contacting portion, wherein said retaining portions and contacting portions of said first conductive contacts are respectively inserted into corresponding said first passages at different depths, said retaining portion secured in corresponding said first passage, said contacting portion exposed in corresponding first passage, said mounting portion extending out from said rear face; and wherein said rear face has a planar surface while the retaining portion of one of the first conductive contacts which is inserted into said first passage at the shallowest depth partially projects out from said planar face.

2. The electrical connector as described in claim 1, wherein said mounting portion of the first conductive contacts are bent downwardly in several rows while the mounting portion of the one inserted into said first passage at the shallowest depth is not in the row near said planar face.

3. The electrical connector as described in claim 1, which further comprising a spacer holding mounting portion of each said first conductive contact in certain position.

4. The electrical connector as described in claim 1, which further comprises a plurality of second conductive contacts respectively secured in said dielectric housing, wherein said first conductive contacts are manufactured according to a first specification while said second conductive contacts are manufactured according to a second specification different to said first specification.

5. The electrical connector as described in claim 1, wherein the length of the first passage into which one of the first conductive contacts inserted at the shallowest depth is shortest.

6. The electrical connector as described in claim 1, wherein the interface of said mating face matches the definition as the serial ATA standard specified.

7. The electrical connector as described in claim 1, wherein each first conductive contact has the same shape and size while the mounting portion of each first conductive contact can be cut into different length and can be bent in different position after inserted into said dielectric housing.

8. An electrical connector for electrical connection between a complementary electrical connector and a printed circuit board comprising: a dielectric housing comprising a mating face and a rear face opposed to said mating face; a plurality of first conductive contacts respectively secured in said dielectric housing, wherein said first conductive contacts are manufactured according to the same specification while at least one of first conductive contacts is inserted into said dielectric housing at a depth shallower than others; and wherein said rear face has a planar surface, each first conductive contact comprises a retaining portion for retained in said dielectric housing, a contacting portion extending from a end of said retaining portion for electrical connection with the complementary electrical connector, and a mounting portion extending from the end opposite to said contacting portion for electrical connection with the printed circuit board, wherein the retaining portion of said at least one of first conductive contacts is inserted into said dielectric housing at a depth shallower than others do partially projects out from said planar face.

9. The electrical connector as described in claim 8, wherein said mounting portion of the first conductive contacts is bent downwardly in several rows while the mounting portion of the one inserted into said dielectric housing at a depth shallower than others is not in the row near said planar face.

10. The electrical connector as described in claim 8, which further comprising a spacer holding mounting portion of each said first conductive contact in certain position.

11. The electrical connector as described in claim 8, which further comprises a second conductive contacts respectively secured in said dielectric housing, wherein said first conductive contacts are manufactured according to a first specification while said second conductive contacts are manufactured according to a second specification different to said first specification.

12. The electrical connector as described in claim 8, wherein the interface of said mating face matches the definition as the serial ATA standard specified.

13. The electrical connector as described in claim 8, wherein each first conductive contact has the same shape and size while the mounting portion of each first conductive contact can be cut into different length and can be bent in different position after inserted into said dielectric housing.

* * * * *